United States Patent [19]

Ahmann

[11] Patent Number: 4,569,564

[45] Date of Patent: Feb. 11, 1986

[54] COMPACT PORTABLE VOTING BOOTH

[76] Inventor: John E. Ahmann, 1400 Duhig Rd., Napa, Calif. 94558

[21] Appl. No.: 598,065

[22] Filed: Apr. 9, 1984

[51] Int. Cl.[4] ..... A47B 43/02

[52] U.S. Cl. ..... 312/259; 108/34; 206/44 R; 229/33; 248/174; 312/233; 312/258

[58] Field of Search ..... 312/258, 259, 262, 239, 312/231, 196, 140.2, 233; 206/44 R; 229/33, 36; 248/174; 108/33, 34, 38, 41

[56] References Cited

U.S. PATENT DOCUMENTS

| | | | |
|---|---|---|---|
| 2,926,780 | 3/1960 | Osteen | 229/33 X |
| 3,071,307 | 1/1963 | Keller | 229/33 |
| 3,164,350 | 1/1965 | Taub | 248/174 |
| 3,300,166 | 1/1967 | Wojciechowski | 248/174 |
| 3,381,880 | 5/1968 | Lewallen et al. | 229/36 |
| 3,544,184 | 12/1970 | Laws | 312/259 |
| 3,562,929 | 2/1971 | Emore, Jr. | 312/262 X |
| 3,645,382 | 2/1972 | Abrams | 229/33 X |
| 3,721,413 | 3/1973 | Robinson | 248/174 |
| 4,258,833 | 3/1981 | Simms | 108/41 X |
| 4,484,787 | 11/1984 | Stephens | 108/60 X |

FOREIGN PATENT DOCUMENTS

| | | | |
|---|---|---|---|
| 1333426 | 6/1963 | France | 312/262 |
| 1350885 | 12/1963 | France | 312/259 |
| 16002 | of 1884 | United Kingdom | 312/233 |

*Primary Examiner*—William E. Lyddane
*Assistant Examiner*—Thomas A. Rendos
*Attorney, Agent, or Firm*—Owen, Wickersham & Erickson

[57] ABSTRACT

A compact, foldable voting booth of corrugated cardboard or other suitable material can be set up in seconds into a sturdy voting booth of standard height. In storage or transit configuration, it is folded and forms into a compact, portable box/carrying case. The voting booth is of two components, a top portion which is the carrying case and also forms the voting table, and a base portion which can be folded and stored inside the carrying case. The top portion is in the form of a container having a lid which is swung pivotally around against the bottom of the container to expose a back shield and a pair of side shields, forming the voting table. The container is placed, with its open side down, on the erected rectangular base portion.

14 Claims, 11 Drawing Figures

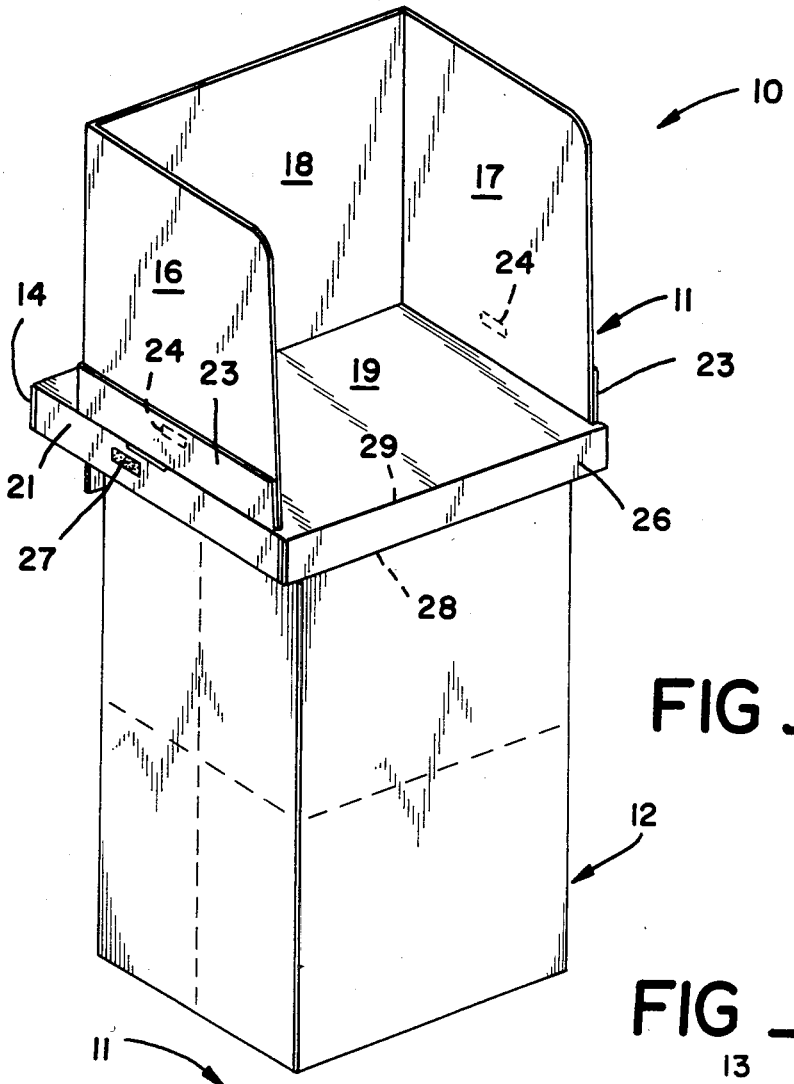
FIG _ 1
FIG _ 2
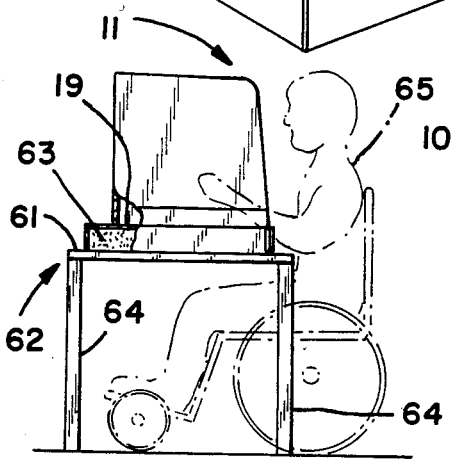
FIG _ 11
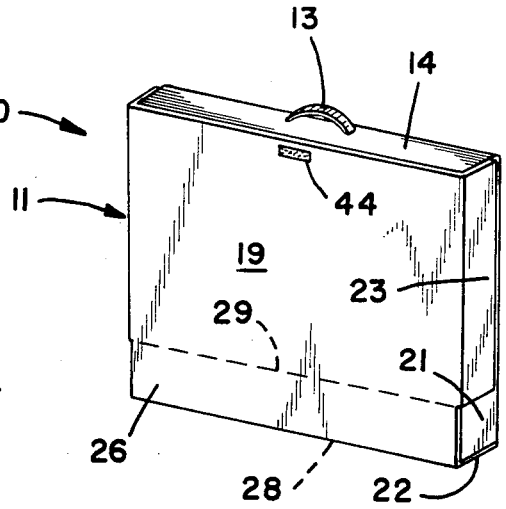

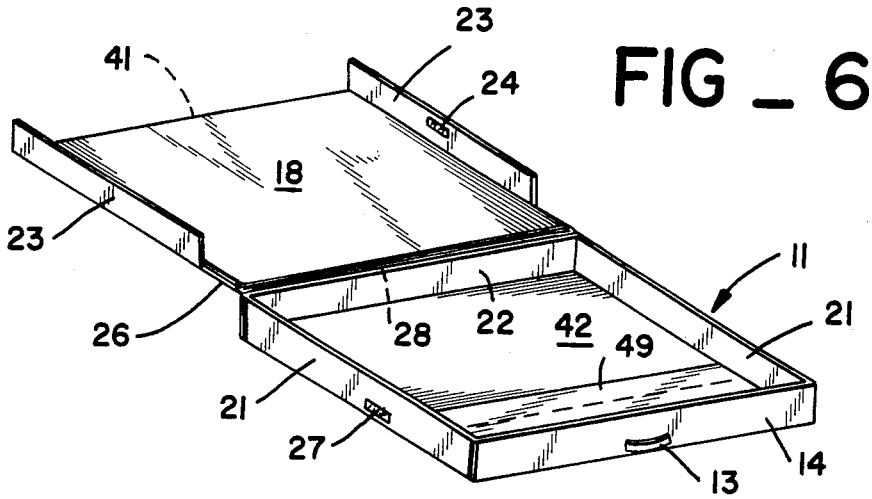
FIG _ 6
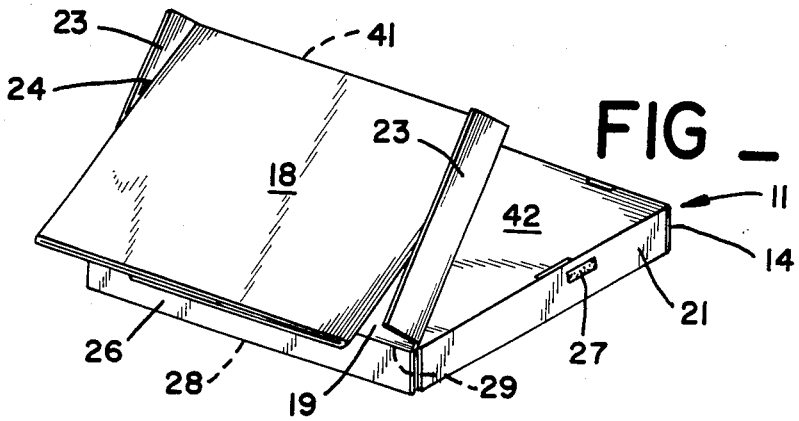
FIG _ 7
FIG _ 8
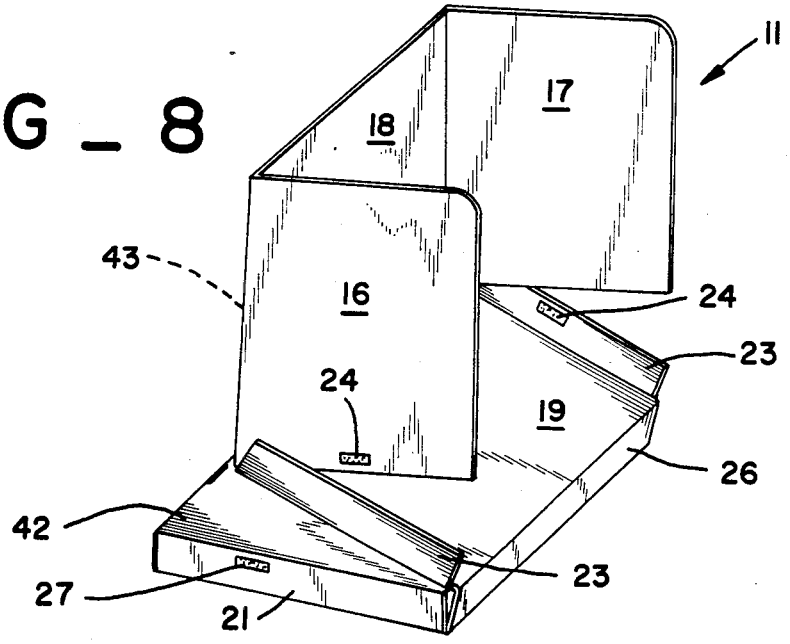

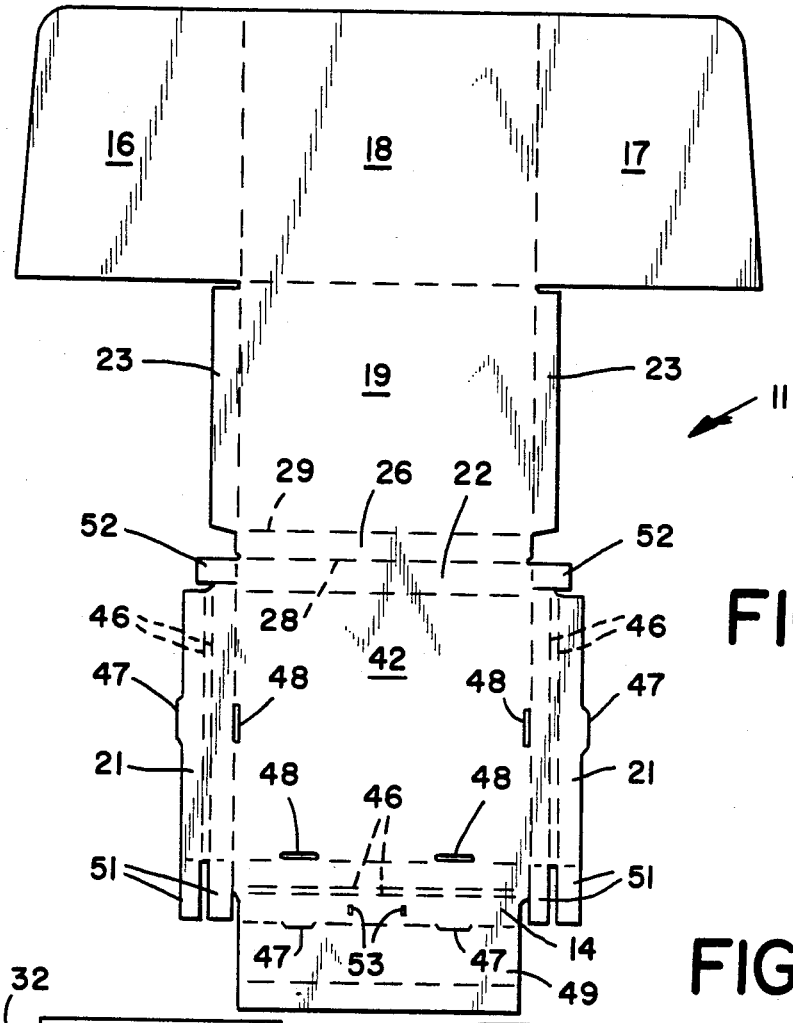
FIG _ 9
FIG _ 10
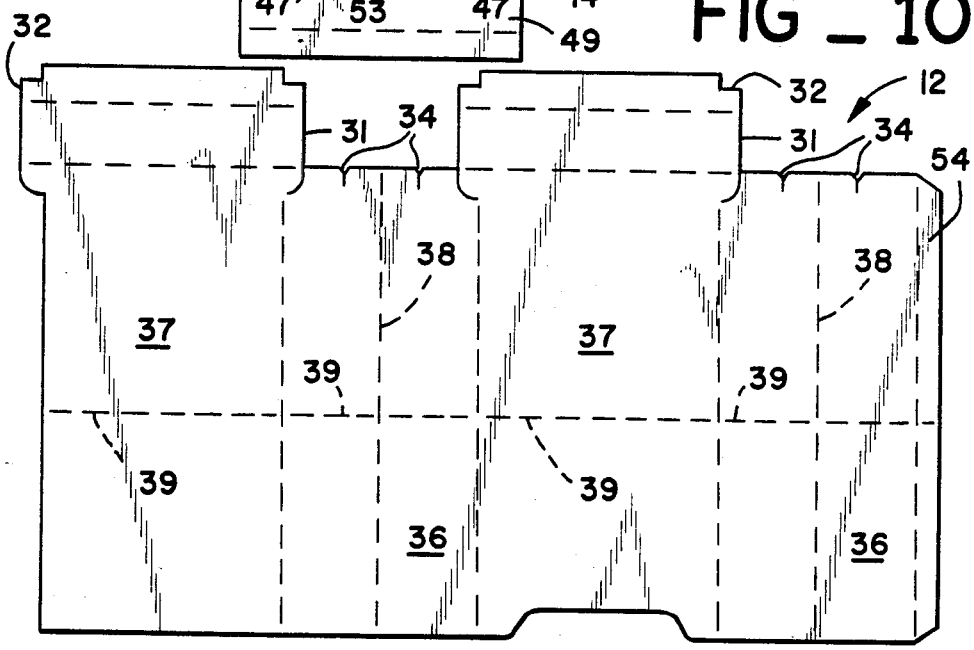

COMPACT PORTABLE VOTING BOOTH

BACKGROUND OF THE INVENTION

The invention relates to portable voting equipment, and more particularly to a voting booth formed of corrugated or other lightweight, strong material, stored and transported as a compact carrying case and erectable very quickly into a voting booth of standard height.

Various forms of portable voting booths having been suggested and used previously. Some have included metal carrying cases with internally stored break-apart legs and fold-out side shields. Others have been formed of corrugated material, such as a product marketed as VOTABOOTH by Jack Woods and Associates. The VOTABOOTH product included a corrugated base portion similar to a corresponding element of the present invention. The VOTABOOTH comprised a total of three pieces, two functional pieces which were put into a box, which comprised the third piece.

All prior corrugated voting booths, whether of two or more pieces, differed considerably from the present invention described below. Prior booths were not as compact as the present invention, not as easily and quickly set up and taken down, and not as easily transported and stored. In many areas, methods of handling corrugated voting booths have involved shipping them to the precincts, using them one time only, and then discarding them.

It is among the objects of the present invention to provide an improved, reusable corrugated voting booth of two components, which can be very quickly set up and taken down and repacked into a compact, lightweight carrying case.

SUMMARY OF THE INVENTION

The present invention is an improved foldable, corrugated voting booth which can be stored and transported in very compact form, as a carrying case containing all components. It is a two-piece structure: the carrying case itself, which opens and unfolds generally inside-out to form a voting table with side shields and a back shield; and a base which folds up and is stored inside the carrying case. From the set up position to the storage position, the top portion is folded around and under and into the under side of the table, along with the folded base, to form a thin box-like carrying case which may be, for example, about 21" by 24" by 2¼" thick, weighing only about five pounds when constructed of two hundred pound test corrugated board. The booth can be made of other lightweight sheet materials, such as "CORA-PLAST", a corrugated plastic material.

According to the invention, a compact, foldable voting booth, all of lightweight material, includes a base portion formed as a separate piece, of hollow tube-like configuration with fold lines enabling it to be folded compactly and generally flat, and a top portion for providing a voting table which is partially enclosed for privacy. The top portion preferably is formed of a single blank of corrugated material in the form of a container with an open top, four short sides and a bottom, being large enough for the folded base portion to be inserted and stored therein. A hinged short flap extends from the top of one of the short sides along a first fold line, the short flap being only slightly longer than the height of the short sides. A flat container lid extends from the short flap along a second fold line parallel to the first, and a back shield member extends from the container lid along a third fold line opposite and parallel to the second. The back shield member has a pair of side shields extending from sides thereof along fourth fold lines perpendicular to the third. The side shields and the back shield member are of such size that the side shields may be folded together against the back shield member, and the back shield member folded against the lid with the side shields between, then the short flap and container lid swung to a position closing the container. Releasable fastening means are provided for retaining the container closed.

For set up of the voting booth, the short flap and container lid may be folded back away from the open top of the container until the short flap is against the outside of the short side to which it is connected and the container lid is against the outside of the bottom of the container bottom. Then the back shield member and side shields are opened away from the container lid and perpendicular to the container lid to form the voting table, with the container inverted and its open top facing downwardly. Releaseable attachment means are provided for retaining the side shields and back shield in the opened position. The top portion, in the opened position as a voting table, is stacked on the opened base portion, with the downward-oriented open top of the container fitted over the base portion.

Preferably, a pair of side flaps are provided, extending from opposite sides of the container lid along fifth fold lines perpendicular to the second fold line, so that they overlap corresponding sides of the container when the container lid is in the closed position, and also positioned to overlap the side shields at their lower edges when the top portion is in the opened position as a voting table. Both the releasable fastening means and the releasable attachment means preferably include a first fastener element on the inner side of each of the side flaps, and cooperating fastener elements, one on each said corresponding side of the container positioned for engagment with a first fastener element of a side flap when the container is closed, and one on each side shield positioned for engagement with a first fastener element when the top portion is in the opened position as a voting table.

It is a principal object of the invention to provide a fast, efficient, inexpensive and reusable foldable corrugated voting booth, of only two components. These and other objects, advantages, features and characteristics of the invention will be apparent from the following description of a preferred embodiment, considered along with the accompanying drawings.

DESCRIPTION OF THE DRAWINGS

FIG. 1 is a perspective view showing a voting booth according to the invention, fully erected.

FIG. 2 is a perspective view showing the voting booth folded into a compact carrying case.

FIG. 6 is a similar view, but showing the case opened further, with the base removed.

FIG. 7 is another perspective view showing the top portion, or carrying case portion, further opened, with the open side of the container down and the container lid approaching the upwardly oriented bottom of the container.

FIG. 8 is a perspective view, showing the top portion nearly completely erected as a voting table.

FIG. 9 is a view showing a flat blank of corrugated material.

FIG. 10 is a view showing a flat blank of corrugated marterial for the base portion.

FIG. 11 is a side elevation view showing the top portion alone, set up as a voting table, but placed on an ordinary table top for use by persons in wheelchairs.

DESCRIPTION OF A PREFERRED EMBODIMENT

Figure 3:
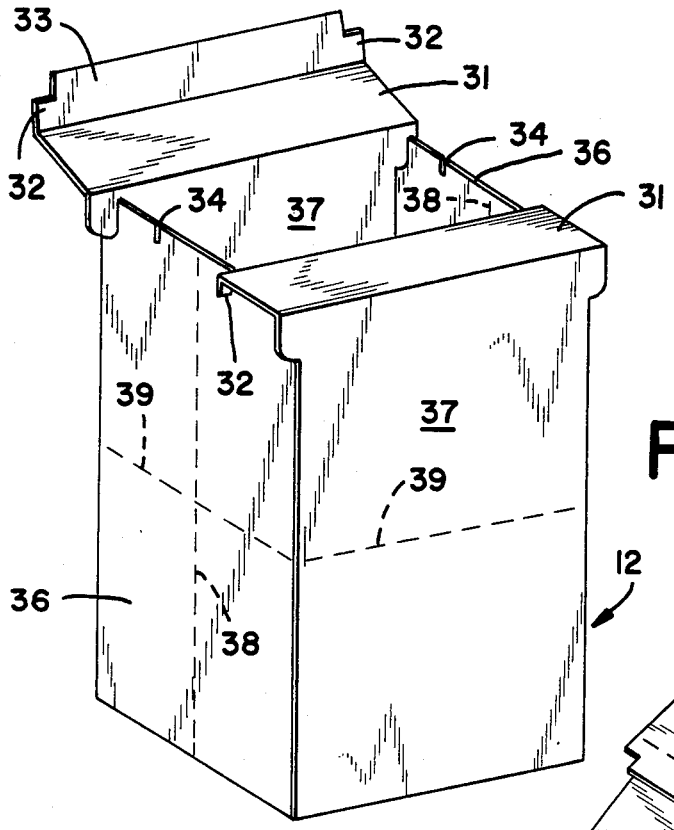
FIG. 3 is a view showing only a base portion of the voting booth, nearly fully erected.

In the drawings, FIG. 1 shows an erected portable voting booth 10 formed of corrugated paper material, or other lightweight, strong material such as "Cora-Plast", a corrugated plastic material, including a top portion 11 and a base 12. FIG. 2 shows the top portion 11 folded into a compact carrying case, with the folded base 12 inside. A carrying handle 13 is secured to one short side wall 14 of the carrying case 11, for convenient portability. As noted above, the overall dimensions of this carrying case 11 may be about 21"×24"×2¼" thick, weighing approximately five pounds when constructed of two hundred pound test corrugated board.

The erected voting booth 10 includes in the top portion 11 a pair of side shields 16 and 17, a back shield member 18, a voting table surface 19 comprising a container lid, four short sides 21 (left and right), 22 (FIG. 2) and 14, and a pair of short side flaps 23 extending from the container lid 19 and retaining the side shields 16 and 17 in position by means of releasable fastening devices 24, cooperative between the side flaps 23 and the side shields (in dashed lines). In FIG. 1, a short flap 26 is seen at the front of the top portion 10, connected to the container lid 19 and to the short side 22, which it overlaps and which is not seen in FIG. 1.

Figure 5:
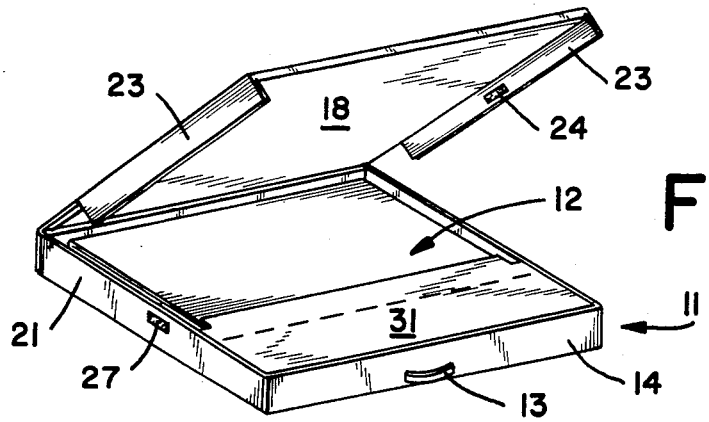
FIG. 5 is a perspective view showing the folded voting booth with the carrying case partially opened, showing the folded base inside.

FIG. 2 shows the entire voting booth 10 as folded and closed into a compact carrying case or container comprising the top portion 11. The container lid 19 is seen closing the top of the case or container, appearing at the front as viewed in FIG. 2, and the surface of the container lid 19 seen in FIG. 2 is the outside, opposite from the side seen in FIG. 1. The side flaps of the container lid are folded against the short sides 21 of the container and held there by cooperating releasable fasteners 27 (on the short sides 21) and 24 (on the side flaps 23), as shown in FIGS. 1 and 5, for example.

Again referring to FIG. 2, the short flap 26 is seen as part of the case closure, extending from the short side 22 along a first fold line 28 and connected to the container lid 19 by a second fold line 29. The container lid 19 and short flap 26 align in a single plane to form the container closure in the position in FIG. 2, as will be seen in greater detail below.

FIG. 3 shows the base 12 of the voting booth 10, with a pair of top flaps 31, one of which is shown opened to indicate the manner of assembly. Tabs 32 of flap ends 33 are tucked into slots 34 at the tops of sides 36 of the generally tubular base portion 12. The resulting structure is sturdy and relatively rigid.

Figure 4:
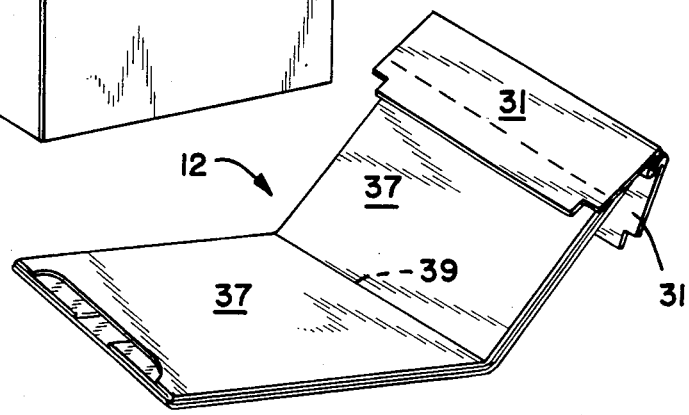
FIG. 4 is a perspective view showing the base portion partially folded.

When the base 12 is to be folded up for storage, the flaps 31 are opened and folded back against front and back panels 37, then the sides 36 are folded inwardly along vertical fold lines 38. Next, the generally planar folded base is again folded along horizontal fold lines 39 in the front and rear and also in the side panels, as indicated in FIG. 4. The base portion 12 is folded entirely flat along the fold line 39, then stored inside the container or top portion 11, as indicated in FIG. 5.

FIGS. 5, 6, 7 and 8 show the sequence of opening, unfolding and erection of the container/top portion 11 into a voting table, as it is shown in FIG. 1. First, the carrying case 11 is opened by releasing the fasteners 24, 27 on the lid's side flaps 23 and the container's short sides 21, as shown in FIG. 5. The folded base 12 is removed from the container.

As shown in FIG. 6, the container 11 is swung open further, about the fold line 28 between the short flap 26 and the short side 22. The back shield 18 is exposed at the inside of the container lid, connected thereto by a fold line 41. The back shield 18 and the connected side shields between it and the container lid appear between the side flaps 23 but are not connected directly hereto.

In FIG. 7 the container has been inverted, with its open side down and a bottom 42 of the container upward. The container lid 19 has been folded further back, from the position shown in FIG. 6, so that it approaches contact with the bottom 42 of the container. The short flap 26 folds back along the fold line 28 and against the adjacent short side 22, and the container lid 19 then folds further back along the fold line 29, no longer coplanar with the short flap 26. The back shield 18 is shown beginning to unfold from the container lid, along the fold line 41.

FIG. 8 shows the top portion 11 just before completion of erection into the completed structure shown resting on the base 12 in FIG. 1. The back shield 18 has been swung open from the container lid 19, and the side shields 16 and 17 have been swung to the open position from the back shield along fold lines 43. The side shields will be positioned against the container lid 19 and the side flaps 23, and held in place by the releasable fastener devices 24, as shown in FIG. 1. The container lid 19 will be swung down into position against the container bottom 42, and similar releasable fastener devices 44 on the container bottom and on the outside surface of the container lid, as shown in FIG. 2, will engage to hold these panels together, in the position shown in FIG. 1.

The releasable fasteners preferably comprise interengaging hook and loop fastener means such as VELCRO material. It is seen from the drawings that the VELCRO patches 24 on the side flaps of the container perform two functions—holding the container closed, in the carrying case configuration of FIG. 2, in cooperation with the patches 27; and holding the voting table in the erected configuration via the side shields 16 and 17, as in FIG. 1, in cooperation with the other VELCRO patches 24 on the side shields.

The erected top portion 11, with the open side of the container downward, is then set upon the top of the base 12 to form the complete voting booth 10 shown in FIG. 1.

FIGS. 9 and 10 show flat blanks for forming the top portion 11 and the base 12 of the voting booth, respectively. In FIG. 9 the various components of the container/top portion 11 are indicated by reference numerals corresponding to those of FIGS. 1, 2, and 5 through 8. It is also seen that on three of the short sides 14 and 21 of the container, the short sides preferably comprise double-thickness walls, folded along double fold lines 46, with tabs 47 inserted into slots 48 to form a sturdy container structure. An inner flap 49 may extend from the short side 14, to partially line the bottom 42 of the assembled container, as also seen in FIG. 6. Tabs 51, extending from the short sides 21, and 52, extending from the short side 22, are sandwiched into adjacent right-angle sides as the container is erected, to strengthen the corners and increase the integrity of the container. A pair of holes 53 preferably are provided in the short side 14 of the container for receiving the carrying handle 14 (FIGS. 2, 5 and 6).

FIG. 10, showing the flat blank of corrugated (or other suitable lightweight, strong board for the base 12 of the voting booth 10 of the invention, also indicates the various components by the same reference numerals used above. As indicated, one of the side panels 36 preferably includes a foldable end tab 54, for gluing to the more distant panel 37 upon assembly.

In FIG. 11 the container/top portion 11 is shown set up as a voting table but without the base 12. Instead, it is supported on the top 61 of an ordinary table 62, placed flatly thereon, preferably with a piece of filler material 63 for supporting the voting table surface 19 (see also FIG. 1) adequately as a working surface. The filler material 63 may be a slab of expanded polystrene (styrofoam) or similar material, simply laid on the table top 61 prior to placement of the erected voting booth 11 on the table. This table top setup enables the booth of the invention to be used by handicapped voters in wheelchairs, since open space is left beneath the table top 61 between legs 64 of the table.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

I claim:

1. A compact, foldable voting booth of lightweight foldable sheet material, capable of being set up into a sturdy voting booth of standard height and of being folded into itself as a compact portable box, comprising:

a base portion formed as a separate piece, of hollow tube-like configuration, with fold lines enabling the base portion to be folded compactly and generally flat;

a top portion for providing a voting table, partially enclosed for privacy, and comprising: a shallow rectangular container of folded corrugated material and having an open top, four short sides and a bottom, and being large enough for the folded base portion to be inserted and stored therein; a hinged short flap extending from the top of one of the short sides along a first fold line, the short flap being only slightly longer than the height of the short sides; a flat container lid extending from the short flap along a second fold line parallel to the first; a back shield member extending from the container lid along a third fold line opposite and parallel to the second, the back shield member having a pair of side shields extending from sides thereof along fourth fold lines perpendicular to the third; said side shields and the back shield member being of such size that the side shields may be folded together against the back shield member, and the back shield member folded against the lid with the side shields between, then the short flap and container lid swung along the first fold line to a position closing the open top of the container, with the short flap and container lid generally coplanar; and releasable fstening means for retaining the container closed;

said short flap and container lid being foldable back away from the open top of the container until the short flap is against the outside of the short side to which it is connected and the container lid is against the outside of the container bottom, whereupon the back shield member and side shields may be opened away from the container lid and perpendicular to the container lid to form the voting table with back shield and side shields, with the container inverted, its open top facing downwardly and including releasable attachment means for retaining the side shields and back shield in the opened position;

said top portion, in the opened position as a voting table, being stackable on the opened base portion with the open top of the container fitted over the base portion.

2. The foldable voting booth of claim 1, wherein the flat container lid includes a pair of short side flaps extending from opposite sides of the container lid along fifth fold lines perpendicular to the second fold line, positioned to overlap corresponding short sides of the container when the container lid is in the closed position, and positioned to overlap the side shields at their lower edges when said top portion is in the opened position as a voting table, and boths said releasable fastening means and releasable attachment means including a first fastener element on the inner side of each of the side flaps, and cooperating second fastener elements, one on each said corresponding short side of the container positioned for engagement with the first fastener element of the corresponding side flap when the container is closed, and one on each side shield positioned for engagement with the first fastener element of the corresponding side flap when said top portion is in the opened position as a voting table.

3. The foldable voting booth of claim 2, wherein the first and second fastener elements comprise interengaging hook and loop fastener means.

4. The foldable voting booth of claim 1, wherein the outside of the container lid and the outside of the container bottom include corresponding releasable fastener means, for holding the container lid against the outside of the container bottom when said top portion is in the opened position as a voting table.

5. The foldable voting booth of claim 4, wherein the corresponding releasable fastener means comprise interengaging hook and loop fastener means.

6. The foldable voting booth of claim 1, wherein said top portion comprises a single contiguous piece of corrugated material.

7. A compact, foldable voting table of lightweight sheet material, capable of being set up into a sturdy voting booth partially enclosed for privacy, and of being folded into itself as a compact portable box, comprising:

a shallow rectangular container of folded corrugated material and having an open top, four short sides and a bottom, and being large enough for a folded base portion to be inserted and stored therein;

a hinged short flap extending from the top of one of the short sides along a first fold line, the short flap being only slightly longer than the height of the short sides, a flat container lid extending from the short flap along a second fold line parallel to the first;

a back shield member extending from the container lid along a third fold line opposite and parallel to the second, the back shield member having a pair of side shields extending from sides thereof along fourth fold lines perpendicular to the third;

said side shields and the back shield member being of such size that the side shields may be folded together against the back shield member, and the back shield member folded against the lid with the side shields between, then the short flap and container lid swung along the first fold line to a position closing the open top of the container, with the short flap and container lid generally coplanar; and releasable fastening means for retaining the container closed;

said short flap and container lid being foldable back away from the open top of the container until the short flap is against the outside of the short side to which it is connected and the container lid is against the outside of the container bottom, whereupon the back shield member and side shields may be opened away from the container lid and perpendicular to the container lid to form the voting table with back shield and side shields, with the container inverted, its open top facing downwardly and including releasable attachment means for retaining the side shields and back shield in the opened position;

the opened, set up voting table being adapted for placement on a suitable support for use as a voting booth.

8. The foldable voting table of claim 7, wherein the flat container lid includes a pair of short side flaps extending from opposite sides of the container lid along fifth fold perpendicular to the second fold line, positioned to overlap corresponding short sides of the container when the container lid is in the closed position, and positioned to overlap the side shields at their lower edges when said top portion is in the opened position as a voting table, and both said releasable fastening means and releasable attachment means including a first fastener element on the inner side of each of the side flaps, and cooperating second fastener elements, one on each said corresponding short side of the container positioned for engagement with the first fastener element of the corresponding side flap when the container is closed, and one on each side shield positioned for engagement with the first fastener element of the corresponding side flap when the voting table is in the opened, set up position.

9. The foldable voting table of claim 8, wherein the first and second fastener elements comprise interengaging hook and loop fastener means.

10. The foldable voting table of claim 7, wherein the outside of the container lid and the outside of the container bottom include corresponding releasable fastener means, for holding the container lid against the outside of the container bottom when said voting table is in the opened, set up position.

11. The foldable voting table of claim 10, wherein the corresponding releasable fastener means comprise interengaging hook and loop fastener means.

12. The foldable voting table of claim 7, comprising a single contiguous piece of corrugated material.

13. The foldable voting table of claim 7, further including a piece of filler material of suitable size and thickness to be placed on a table top to fill the open space of the inverted container to provide a sturdy working surface.

14. The foldable voting table of claim 7, in combination with a table having a top on which the set up voting table is placed, with open space beneath the top for the legs of wheelchair-bound persons.

* * * * *